US012152597B2

(12) United States Patent
Haegele et al.

(10) Patent No.: US 12,152,597 B2
(45) Date of Patent: Nov. 26, 2024

(54) FAN WHEEL DRIVEN IN ONLY ONE ROTATIONAL DIRECTION

(71) Applicant: IE ASSETS GMBH & CO. KG, Schorndorf (DE)

(72) Inventors: Karl Haegele, Schorndorf (DE); Markus Lechler, Schorndorf (DE); Samuel Arnold, Urbach (DE)

(73) Assignee: IE ASSETS GMBH + CO. KG, Schorndorf (DE)

( * ) Notice: Subject to any disclaimer, the term of this patent is extended or adjusted under 35 U.S.C. 154(b) by 0 days.

(21) Appl. No.: 18/205,021

(22) Filed: Jun. 2, 2023

(65) Prior Publication Data

US 2023/0304503 A1 Sep. 28, 2023

(51) Int. Cl.
*F04D 27/00* (2006.01)
*F04D 25/06* (2006.01)

(52) U.S. Cl.
CPC ..... *F04D 27/00* (2013.01); *F04D 25/06* (2013.01)

(58) Field of Classification Search
CPC ..... F04D 19/005; F04D 25/06; F04D 27/00; F04D 27/002; F04D 29/36; F04D 29/362; F04D 29/366
See application file for complete search history.

(56) References Cited

U.S. PATENT DOCUMENTS 7,179,054 B1 * 2/2007 Borges ..... F04D 29/362 415/13
11,708,836 B2 * 7/2023 Haegele ..... F04D 19/002 415/122.1
2021/0164355 A1 * 6/2021 Haegele ..... F04D 19/005

FOREIGN PATENT DOCUMENTS

WO WO-2019242799 A1 * 12/2019 ..... F01D 7/02

OTHER PUBLICATIONS

WO-2019242799-A1 machine translation, published Dec. 26, 2019 (Year: 2019).*

* cited by examiner

*Primary Examiner* — David E Sosnowski
*Assistant Examiner* — Jason G Davis
(74) *Attorney, Agent, or Firm* — Ronald S. Lombard

(57) ABSTRACT

A fan wheel including a fan wheel hub with fan blades supported rotatably on the fan wheel hub so as to extend radially therefrom, and a fan wheel drive accommodated in the fan wheel hub so as to be rotatable relative thereto within a limited angular range and connected to the fan blades for a corresponding rotation of the fan blades about their longitudinal axes, whereby the flow direction of the fan wheel is reversible by an inertia-based rotation of the fan wheel relative to the fan wheel drive.

8 Claims, 3 Drawing Sheets

FAN WHEEL DRIVEN IN ONLY ONE ROTATIONAL DIRECTION

CROSS-REFERENCE TO RELATED APPLICATIONS

Reference is made to U.S. patent application Ser. No. 17/025,284 filed Sep. 18, 2020, by the present applicant, IE ASSETS GMBH & CO. KG, for an invention, entitled "Fan Wheel Driven In Only One Rotational Direction". The said U.S. patent application Ser. No. 17/025,284 issued as U.S. Pat. No. 11,365,749 B2 on Jun. 21, 2022.

BACKGROUND OF THE INVENTION

The invention concerns a fan wheel which is driven in only one rotational direction with fan blades which extend radially from the fan wheel hub in which they are supported so as to be rotatable about their blade axes and are driven by the hub. The fan blades are inclined with respect to the plane of rotation of the fan wheel and their inclination is switchable via a switch-over plane extending transverse to the plane of rotation of the fan wheel so that their blade angles can be adjusted to opposite blowing directions.

Such fan wheels are generally known but are provided with expensive means for the adjustment of the inclination of the blade angle with respect to the plane of rotation of the fan wheel, in particular with respect to a switch-over of the fan blades to an opposite blowing direction through a switch-over plane extending transverse to the plane of rotation of the fan wheel.

It is the object of the present invention to provide means for simplifying this procedure with regard to the functional conditions as well as with regard to the implementation of the switch-over procedure.

SUMMARY OF THE INVENTION

A fan wheel including a fan wheel hub with fan blades supported rotatably on the fan wheel hub so as to extend radially therefrom, and a fan wheel drive accommodated in the fan wheel hub so as to be rotatable relative thereto within a limited angular range and connected to the fan blades for a corresponding rotation of the fan blades about their longitudinal axes, whereby the flow direction of the fan wheel is reversible by an inertia-based rotation of the fan wheel relative to the fan wheel drive.

In this way, caused by a speed reduction of the fan wheel drive up to an interruption of the drive, with a stop-limited free movability of the fan wheel for driving the fan blades to a switch-over plane by inertia-based mass-force dependent rotation of fan wheel and by an aerodynamic impact the fan blades can be rotated about the fan blade axes for a switch-over to the opposite blow directions of the fan wheel. The rotational or turning movements of the fan blades in the switch-over plane can in this way be initiated, supported and/or accelerated so that the switch-over of the fan blades between opposite flow direction positions of the fan blades can be achieved with very short switch-over times.

With the use of available operating capabilities the solution according to the invention can be realized without additional expenditures. This can be done in particular with common measures since controls for the drive of the fan wheels are generally anyway present and the utilization of mass forces depending on speed changes of the drive are possible without additional expenditures. The stop-limited free-wheeling movement of the fan wheel permits further an inertia-based rotation of the fan wheel: by a rapid speed reduction or interruption of the drive force or, respectively, a rapid acceleration of the drive offers the angular positions of the drive relative to the fan wheel can be changed for influencing the adjustment of the angular position of the fan blades about the blade axes for a correction based on aerodynamic points of view.

The possible effects on the operation of the fan wheel and on operation-dependent corrections in the mode of operation such as for example the switch-over from a suction operating mode of the fan wheel to a blowing operating mode as provided by the present invention are achieved via effects which are dependent on the adjustment of the angle of the fan wheel blades for opposite blowing directions while the fan wheel direction of rotation remains the same. Starting for example from a suction mode of operation, with the same direction of rotation of the fan wheel, the fan blades can be rotated about the blade axes in a neutral switch-over plane which extends normal to the plane of rotation of the fan wheel to a blowing operating mode by a decrease of the speed of the fan drive. With an increasing speed of the drive, the blades can be rotated about their blade axes, from the blowing operating mode, in an opposite direction to be pivoted again to the original suction generating operating position.

In accordance with this operating sequence and the stop-limited idle movement of the fan wheel with regard to the drive, the fan wheel operation can be controlled between a suction and blow operation solely depending on a change of the drive speed. And this can be achieved almost without additional control expenditures. If necessary, this can be made dependent on desirable additional functions, such as a switch-over between suction and blowing operation based on a pressure application dependency or pressure application basis.

BRIEF DESCRIPTION OF THE DRAWINGS

Below, the fan wheel is described in particular with regard to the functional conditions with respect to a simplified basic design. Further details are explained with reference to the accompanying drawings, which show in.

DETAILED DESCRIPTION OF A PARTICULAR EMBODIMENT OF THE INVENTION

Figure 1:
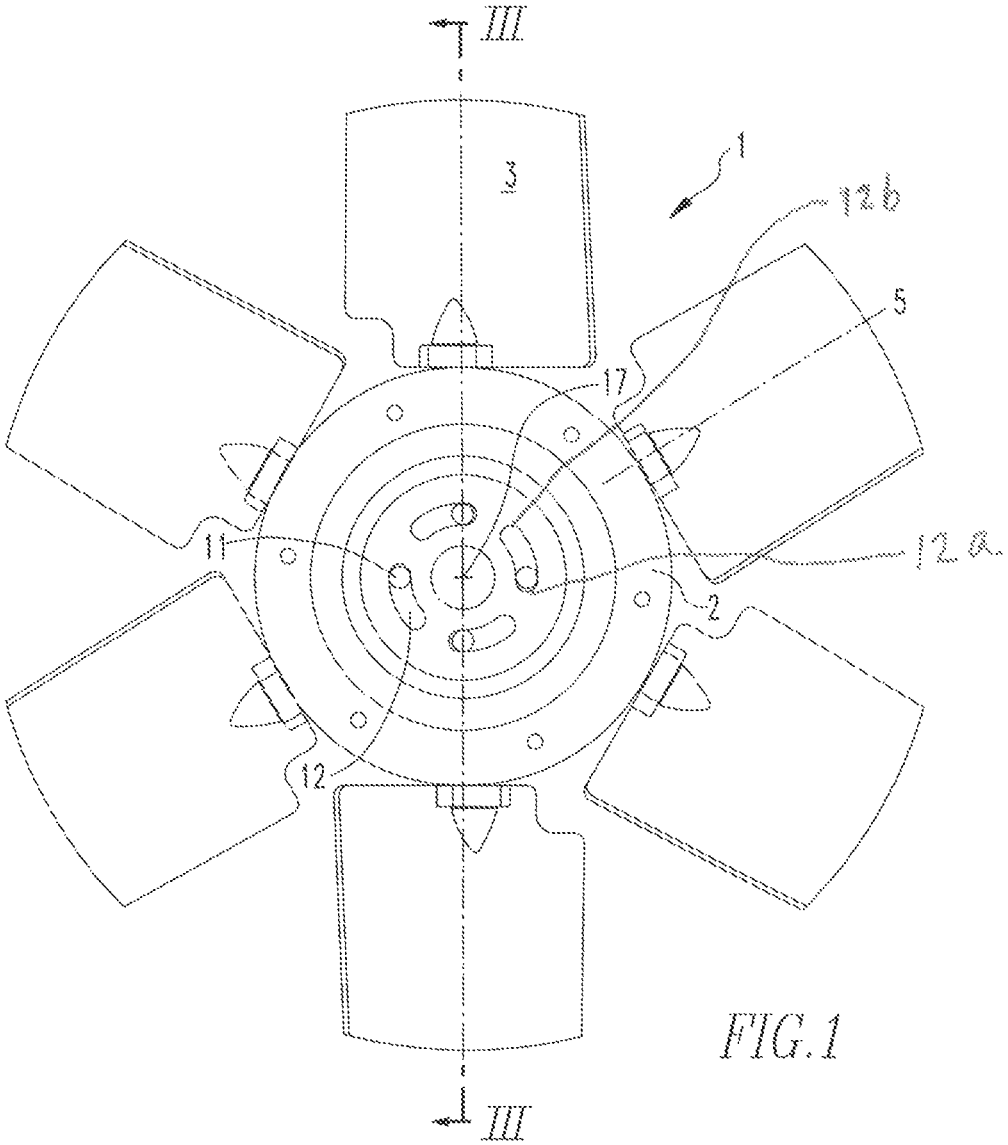
FIG. 1 a front view of the fan wheel including a central, driven hub with radially extending fan blades which are inclined with regard to the plane of rotation of the blade wheel corresponding to the desired flow direction at a certain blade angle and whose rotational positions around the blade axes are stop-limited in their opposite blowing direction end positions, FIG. 2 a schematic representation of the fan wheel in a front view of a fan blade which is inclined with regard to a plane of rotation of the fan wheel by a blade angle, FIG. 3 a schematic and simplified cross-sectional view of the fan wheel taken along line III-III in FIG. 1, and FIG. 4 an operating sequence representation of a fan wheel driven in only one direction for the adjustment of the radial blades which are supported in the fan wheel hub so as to be rotatable about their radially extending axes for obtaining opposite flow directions. For switching the flow direction from one to the opposite direction, i.e., from the suction operating mode to the blow operating mode or vice versa, via a switch-over plane which extends normal to the plane of rotation of the fan wheel, the fan blades are rotated about their radial axes. To this end, the speed of the drive of the fan wheel is reduced or, respectively, increased whereby each fan blade is rotated by the resulting inertia-based rotation of the fan wheel, with respect to the fan drive, to a position in which the flow direction provided by the fan wheel is changed.
Figure 2:
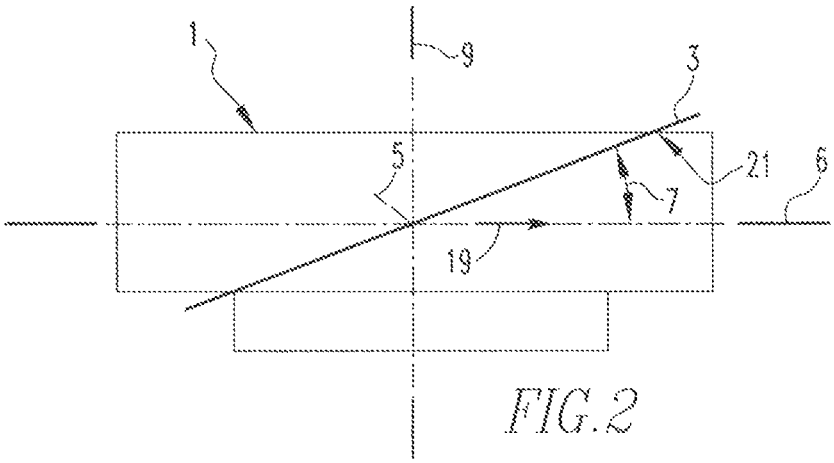
Figure 3:
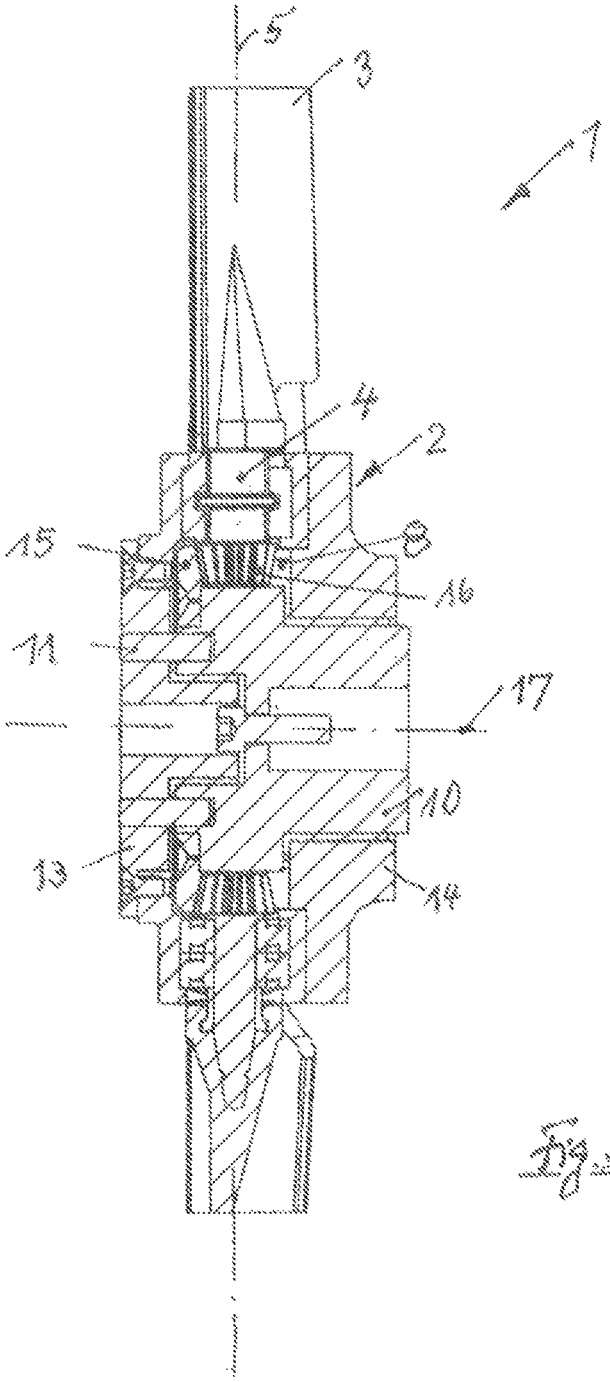
Figure 4:
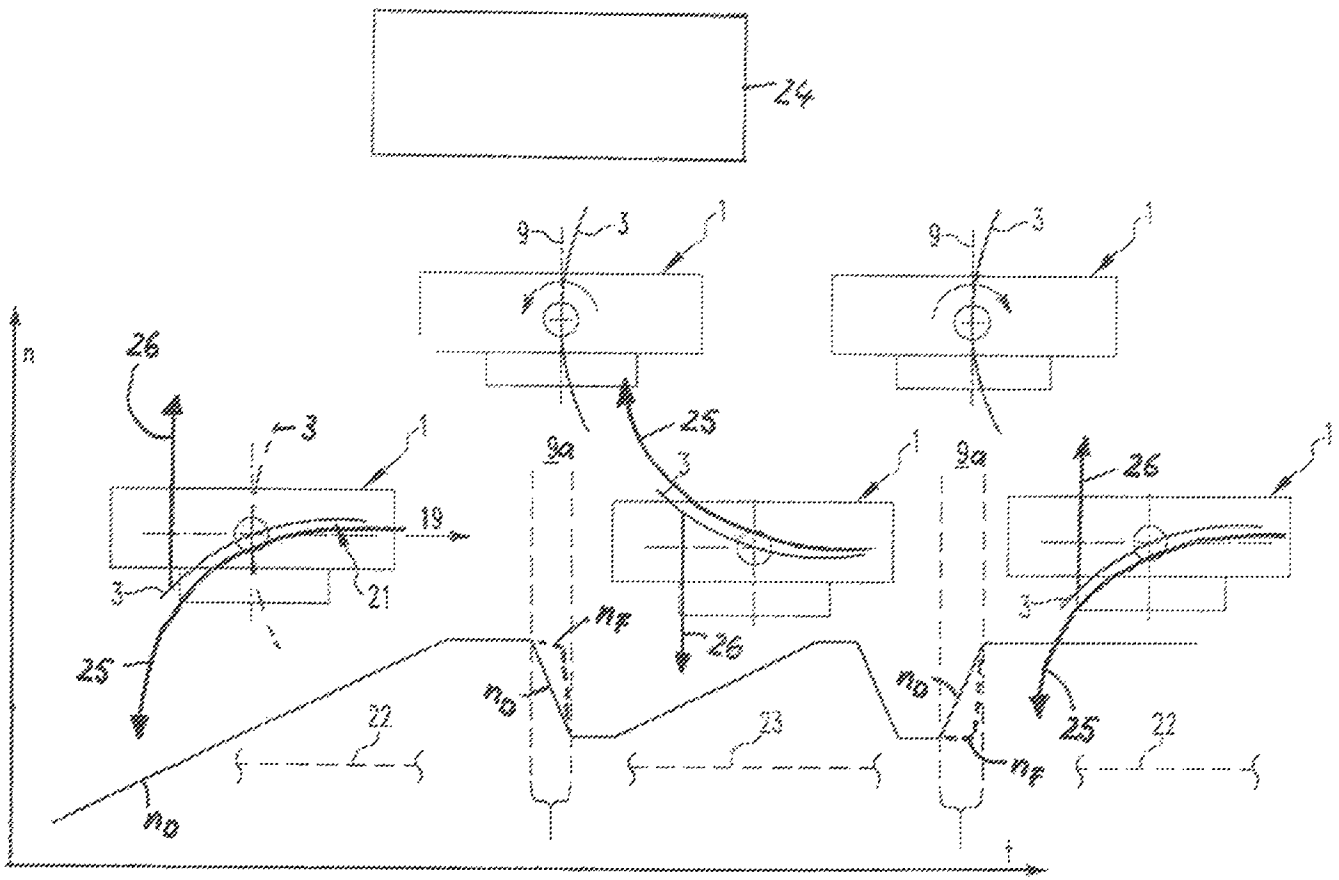

FIGS. 1 and 3 show a fan wheel according to the invention with respect to its essential components. It is designated as a whole with the reference numeral 1. The fan wheel 1 comprises a hub 2 on the circumference thereof radially extending fan blades 3 are arranged. As shown in FIG. 3, the fan blades 3 have, at their feet, blade journals 4 via which they are supported in the hub 2 so as to be rotatable about their radial blade axes 5. In this way, they are each adjustable to generate flows in opposite directions by a rotation over a switch-over plane 9 forming a neutral plane which extends normal to the plane of rotation 6 of the fan wheel 1. The direction of rotation of the fan wheel 1 is indicated in FIG. 2 by the reference numeral 19. The, in accordance with the blade angle 7 forward-facing, front side of the fan blade 5 is designated by the numeral 21. The forward-facing front side 21 of the fan blade 5, preferably is concave, as shown in FIG. 4.

The interior 8 of the hub accommodates the drive 10 of the fan blade wheel 1, preferably an electric motor, arranged so as to support and drive the hub 2. The drive 10 is rotatable about its axis 17 relative to the hub 2 within limits formed by stops. The hub 2 includes a cover part 13 which corresponds to a base part 14 surrounding the drive 10 radially in the area of the blade journals 4. The cover part 13 is provided with the stops in the form of pins or stop elements 11 arranged opposite the drive 10. The pins 11 face the drive 10 and extend into respective guide slots 12 formed in the drive 10. The pins 11 limit the range of rotation of the drive 10 relative to the hub 2 by contacting opposite end faces 12*a*, 12*b* of the respective guide slots 12. The drive 10 is provided, preferably at its front side facing the cover part 13, with an annular gear ring 15 which is in engagement with pinions 16 provided on the foot end journals 4 so as to form a drive connection of the drive 10 with the fan blades 3. The use of cam- and/or eccentric drives is also possible in connection with the invention, not shown in the drawings.

With the stop-limited rotatability of the hub 2 with respect to the drive 10, the fan blades 3 can be transposed about the switch-over plane 9 so as to blow in opposite flow directions while the direction of rotation 19 of the fan wheel 1 remains the same. As shown in FIG. 4 the fan wheel 1 can therefore be operated in a suction or a blowing mode, that is, for example in a suction cooling mode or in a blowing cleaning mode of operation, with respect to the cooler 24, simply by pivoting the fan blades 3 through the switch-over plane 9 to the respective opposite blowing direction. Whereby, the fan blades 3 are in each case so oriented that the same front concave blade side 21 faces the incoming air so that the same operating conditions are provided for the suction and the blowing operation.

In accordance with the present invention the switch-over of the fan blades 3 is initiated by a rapid reduction of the speed of the drive 10. With this speed reduction and a correspondingly reduced aerodynamic air impact on the fan blades 3, the inertia force of the fan wheel causes the switch-over via the switch-over plane 9 of the blades 3. Corresponding with the switch-over plane 9 an area 9*a* delimited by dashed lines is shown in the operating sequence representation of FIG. 4 in which a rapid speed reduction of the drive 10 occurs by the interruption of the power output of the drive 10 resulting in the inertia-based rotation of the fan wheel corresponding to the adjustment range of the fan blades 3.

The switch-over of the fan blades 3 in the area 9*a* of the switch-over plane 9 from a suction operation assumed to be a normal or working operation—indicated in FIG. 4 by the numeral 22—to a blow operation—indicated in FIG. 4 by the reference numeral 23—has been established after passage through the switch-over plane 9. If such a switch-over is performed for example for cleaning purposes this may be in particular a short-period operation. In other applications it may be for longer operations. In any case, the fan wheel can again be returned to the normal operation 22 assumed to be the suction operation as shown in FIG. 4 again dependent on the drive 10 speed. To this end, however, the previous procedure is reversed in that the speed of the drive 10 is increased, in particular rapidly increased, which results in a switch-over of the fan blades 3 via the switch-over plane 9 to a suction operation.

Such reversibility of the fan wheel 1 with respect to the flow direction can also be combined with a possibility to adjust the blade angle 7 of the fan blade 3 with respect to the amount of air moved by the fan wheel which would provide for further application possibilities.

Concerning the different application possibilities for the fan wheel 1 it may be expedient to vary the stop-limited rotation range of the fan wheel hub 2 with respect to the drive 10. The drive 10 can be rotatable relative to the fan wheel hub 2 within elastic stop limits, for example, dependent on thermal set values using thermo elements, shape memory materials or similar. In this respect, it may also be expedient to change the rotational position of the annular gear ring 15 in the drive train of the drive 10 and/or to the hub 2.

As a result, with the present invention a fan wheel 1 is provided which is rotatable only in one direction but whose fan blades 3 are rotatable about the radial fan blade axes 5 in a switch-over plane 9 which extends normal to the plane of rotation 6 of the fan blades 3 by an inertia-based rotation of the fan wheel 1 with respect to the fan drive 10 and by an aerodynamic impact on the fan blades 3 to move the air in opposite directions.

With reference to FIG. 4, a detailed description how the switch-over of the fan blades 3 is accomplished is now given.

As an example, a cooler 24 is schematically shown positioned at the top of FIG. 4. The cooler 24 can be a cooler for an internal combustion engine. Alternatively, cooler 24, by way of a further example, can be a heat exchanger for an air conditioner. An air flow 25 is directed to the concave front side 21 of the fan blades 3 when the fan wheel 1 is turning. At the same time, an aerodynamic force 26 is acting on the fan blades 3 as reaction to the air flow 25. When the fan wheel 1 is rotating in direction 19 the air flow 25 enters the concave front side 21 of the fan blades 3 which creates the aerodynamic force 26 acting on the fan blades 3.

In the suction mode 22, the air flow 25 is directed in the opposite direction of the cooler 24 in order to suck away small particles from the cooler 24. The aerodynamic force 26 is directed towards the cooler 24, on the left side of the fan blade 3, which has the effect that each of the fan blades 3 is urged to turn in the clockwise direction about its rotational radial axis 5. This rotation of the fan blades 3 is prevented by the pins 11 which are positioned at the end face 12*a* of the guide slot 12, see FIG. 1, but the fan blades 3 are stabilized by the aerodynamic force 26 in their actual suction position. Hence, the aerodynamic force 26 prevents the fan blades 3 from turning from the suction mode into the blow mode.

In the blowing mode 23, the air flow 25 is directed towards the cooler 24 in order to clean the surface of the cooler 24 and advantageously also the fan blades 3. The aerodynamic force 26 is directed in the opposite direction of the cooler 24, again, on the left side of each fan blade 3, which has the effect that each of the fan blades 3 want to turn counterclockwise about the rotational radial axis 5. Also, this rotation prevented by the pins 11 which are now positioned at the opposite end face 12*b* of the guide slot 12, so that the fan blades 3 are stabilized by the aerodynamic force 26 in their actual blowing position, too.

The change of position of the fan blades 3 between the suction mode 22 and the blowing mode 23 is accomplished as follows:

As shown in FIG. 3 the fan blades 3 are kinematically coupled with drive 10 via pinion 16 and annular gear ring 15. During operation—either suction or blowing—fan blades 3 maintain their actual position and there is no relative rotation between pinion 16 and annular gear ring 15. But when reducing the speed of drive 10 in the transition from suction operation 22 to blowing operation 23 the inertia force acting on fan wheel 1 maintains the rotational speed of the fan wheel 1. The reduced speed of drive 10 leads to a relative rotation of fan wheel 1 leading to a movement of pins 11 into the opposite respective end face of slots 12. At the same time, due to the kinematical coupling between pinion 16 and annular gear ring 15 the relative rotation of fan wheel 1 with respect to drive 10 changes automatically the position of the fan blades 3 from suction mode 22 to blowing mode 23.

FIG. 4 depicts a coordinate system showing the rotational speed n over time t. For example, the rotational speed n shown in FIG. 4, is in revolutions per minute and the time t is in seconds. The continuous line no is the rotational speed of the drive 10. In the left section of FIG. 4, during the suction mode 22, the drive 10 starts running until reaching a high plateau next to time area 9*a*. As the suction mode is the regular working mode this high plateau may last for some time. During the suction mode 22 the rotational speed $n_F$ of the fan wheel 1 is identical to the rotational speed $n_D$ of the drive 10. The fan wheel 1 may have an operational speed of 2000 revolutions per minute (rpm)—however, this is just an example and depends on the type and size of the fan. In the first time area 9*a*, in FIG. 4 the speed is reduced to 1800 or 1500 rpm within a fraction of a second, typically in a range between several milliseconds to 0.5 seconds. It is important to note that the speed of the whole fan is not reduced, but only the speed of the drive 10, whereas the fan wheel 1 maintains the operational speed so that due to moments of inertia the relative rotation of the fan wheel 1 leads to the desired change of positions of the blades 3. In FIG. 4 the timeline t of the x-axis would be in seconds. However, suction operation 22 can be maintained for several minutes whereas the blowing mode 23 would be maintained only for seconds.

When reaching area 9*a* the rotational speed $n_D$ of the drive 10 is reduced rapidly. Due to inertia forces the rotational speed $n_F$ of the fan wheel 1 which is depicted with dotted line in area 9*a* maintains its velocity as long as the pin 11 moves in the slot 12 from the first end face position 12*a* to the opposite end face position 12*b* which means that the fan blades 3 rotate about their rotational axis and reach their blowing position. When hitting the opposite end face position, the rotational speed $n_F$ of the fan wheel 1 is reduced almost instantly to the level of the rotational speed $n_D$ of the drive 10 and the switch-over of the fan blades 3 from suction mode 22 to blowing mode 23 is finished.

Now referring to blowing mode 23 in the middle section of FIG. 4, the rotational speed $n_D$ of the drive 10 is increased gradually. The same applies to the rotational speed $n_F$ of the fan wheel 1. The increase of the rotational speed $n_D$ of the drive 10 must be significantly lower, about two to five times lower, than the increase of the rotational speed $n_D$ of the drive 10 in the following area 9*a* when switching over again from blowing mode 23 to suction mode 22. When increasing the rotational speed $n_D$ of the drive 10 gradually during the blowing mode 23 the aerodynamic force 26 keeps the fan blades 3 in their blowing position so that the inertia force which is acting on the fan wheel 1 urging them into the opposite position is smaller than the stabilizing effect of the aerodynamic force 26. Hence, the fan blades 3 keep their actual blowing position which is maintained over the whole blowing mode 23.

The rotational speed $n_D$ of the drive 10 is increased gradually until reaching a maximum. After that the rotational speed $n_D$ is reduced in order to get to a low plateau which is the basis for increasing again during the following area 9*a*. Reducing the rotational speed $n_D$ of the drive 10 can be accomplished slowly or fast; in either case the fan wheel 1 and the blades 3 are going to maintain their blowing position as the inertia force acting on the fan wheel 1 can only stabilize the actual fan wheel position but does not change the position.

When reaching the following area 9*a* in the transition from blowing mode 23 to suction mode 22 the rotational speed $n_D$ of the drive 10 is increased rapidly, about two to five times faster than the increase in the antecedent middle section, until reaching the high plateau or maximum again. Due to the inertia force the rotational speed $n_F$ of the fan wheel 1, dotted line in area 9*a*, maintains its velocity as long as the pin 11 moves in the slot 12 from the second end face position 12*b* back to the first, opposite end face position 12*a* which means that the fan blades 3 rotate about their rotational radial axis 5 and reach their suction position again. The inertia force is high enough to overcome the stabilizing effect of the aerodynamic force 26 and frictional forces in the mechanical system. When hitting the first end face position 12*a*, the rotational speed $n_F$ of the fan wheel 1 is increased almost instantly to the level of the rotational speed $n_D$ of the drive 10 and the switch-over of the fan blades 3 from blowing mode 23 to suction mode 22 is accomplished. The fan wheel 1 is now in the right section of FIG. 4 and the rotational speed $n_F$ of the fan wheel 1 can be maintained for a significant amount of time.

LISTING OF REFERENCE NUMERALS

1 fan wheel
2 hub
3 fan blade
4 blade journal
5 radial blade axis
6 plane of rotation
7 blade angle
8 interior of hub
9 switch-over plane
9*a* area
10 drive
11 pins or stop elements
12 guide slot
12*a* first opposite end face of guide slot 12
12*b* second opposite end face of guide slot 12

13 cover part
14 base part
15 annular gear ring
16 pinion
17 drive axis
19 direction of rotation
21 forward facing front side
22 suction operation
23 blow operation
24 cooler
25 air flow
26 aerodynamic force
n rotational speed
$n_F$ rotational speed of the fan wheel 1
$n_D$ rotational speed of the drive 10

What is claimed is:

1. A fan wheel (1) driven in only one direction of rotation, comprising:

a fan wheel hub (2) rotatable relative to a fan wheel drive (10), the fan wheel hub (2) having a stop-limited range of rotation with respect to the fan wheel drive (10), fan blades (3) extending radially from the hub (2), the fan blades (3) supported by the fan wheel hub (2) so as to be rotatable about blade axes (5), the fan blades (3) having a blade angle (7) inclined relative to a plane of rotation (6) of the fan wheel (1) and switchable about a switch-over plane (9) extending transverse to the plane of rotation (6) of the fan wheel (1) for providing two opposite directions of air flow generated by the fan wheel (1), with one of the opposite directions of air flow being a suction operation mode (22) and the other of the opposite directions of air flow being a blow operation mode (23), the fan wheel hub (2) including a cover part (13) including pin like stop elements (11) extending from the cover part (13) operatively arranged facing the fan wheel drive (10), the fan wheel drive (10) having elongated guide slots (12) operatively arranged for receiving the stop elements (11), wherein the range of rotation of the hub (2) with respect to the fan wheel drive (10) about a drive axis (17) of the fan wheel drive (10) is limited by travel of the stop elements (11) in the respective elongated guide slots (12) between a first opposite end face (12*a*) and a second opposite end face (12*b*) of the respective elongated guide slots (12), the fan wheel drive (10) in operative arrangement with the fan blades (3) for rotating the fan blades (3) limited by the stop-limited range of rotation of the hub (2) with respect to the fan wheel drive (10), such that rotational positions of the fan blades (3) around the blade axes (5) are stop-limited in opposite air flow direction end positions, wherein with energization of the fan wheel drive (10) in the suction operation mode (22) the range of rotation of the hub (2) is limited by the respective stop element (11) contacting the first opposite end face (12*a*) of the respective elongated guide slot (12), and upon a rapid speed reduction or interruption of a force of the fan wheel drive (10) sufficient to cause an inertia-based rotation of the hub (2) with respect to the fan wheel drive (10) such that in the suction operation mode (22) the range of rotation of the hub (2) with respect to the fan wheel drive (10) is limited by the respective stop element (11) contacting the second opposite end face (12*b*) of the respective elongated guide slot (12), the fan blades (3) via the blade angle (7) relative to the switch-over plane (9) are configured to be switchable to the blow operation mode (23) from the suction operation mode (22) by the rapid speed reduction or interruption of the force of the fan wheel drive (10) resulting in an inertia-based rotation of the hub (2) limited by the stop-limited travel range of rotation of the hub (2), and in the area of the switch-over plane (9), the fan blades (3) can be switched to the suction operation mode (22) from the blow operation mode (23) by a rapid increase of the speed of the fan wheel drive (10) with respect to the speed of the fan wheel hub (2) sufficient to cause the respective stop element (11) to contact the respective first opposite end face (12*a*) of the respective guide slot (12).

2. The fan wheel (1) driven in only one direction of rotation of claim 1, wherein the fan blades (3) are aided in switching to the two opposite flow directions by changes in an aerodynamic force application on the fan blades (3) acting to aid pivoting the fan blades (3) when switching between the suction operation mode (22) and the blow operation mode (23) or vice versa.

3. The fan wheel (1) driven in only one direction of rotation of claim 2, wherein each of the fan blades (3) have a forward-facing concave front side (21) configured for diverting an air flow in one direction and simultaneously producing an aerodynamic force application on the fan blades (3) in the opposite direction.

4. The fan wheel (1) driven in only one direction of rotation of claim 2, wherein the fan blades (3) are aided in switching to the blow operation mode (23) from the suction operation mode (22) by the rapid reduction of the speed or interruption of the force of the fan wheel drive (10) causing a correspondingly reduced air impact on the fan blades (3).

5. The fan wheel (1) driven in only one direction of rotation of claim 1, further comprising:

the fan blades (3) at foot ends thereof including blade journals (4), the hub (2) in operative supportive relationship with the blade journals (4), the blade journals (4) carrying pinions (16) thereon in operative arrangement therewith for rotating the fan blades (3) about their blade axes (5).

6. The fan wheel (1) driven in only one direction of rotation of claim 4, the fan wheel hub (2) having an interior (8) for accommodating the fan wheel drive (10), the fan wheel drive (10) coaxially operatively arranged in supportive relationship with the fan wheel hub (2) for driving the fan wheel (1), the fan wheel drive (10) having the drive axis (17) about which the fan wheel drive (10) and the fan wheel hub (2) rotate.

7. The fan wheel (1) driven in only one direction of rotation of claim 5, further comprising the fan wheel drive (10) at a front side facing the cover part (13) including an annular gear ring (15) in operative engagement with the pinions (16) for providing a drive connection from the fan wheel drive (10) to the fan blades (3) for rotating the fan blades (3) about the fan blade axes (5) within the stop-limited travel range of rotation of the hub (2).

8. The fan wheel (1) driven in only one direction of rotation of claim 1, wherein the fan wheel drive (10) is an electric motor.

* * * * *